US008831477B2

(12) United States Patent
Huang et al.

(10) Patent No.: US 8,831,477 B2
(45) Date of Patent: Sep. 9, 2014

(54) BEARING MECHANISM FOR PHOTOSENSITIVE DRUM

(71) Applicant: General Plastic Industrial Co., Ltd, Taichung (TW)

(72) Inventors: Shih-Chieh Huang, Cingshuei Township, Taichung County (TW); Min-Hui Tsai, Shalu Township, Taichung County (TW)

(73) Assignee: General Plastics Industrial Co., Ltd, Taichung (TW)

( * ) Notice: Subject to any disclaimer, the term of this patent is extended or adjusted under 35 U.S.C. 154(b) by 17 days.

(21) Appl. No.: 13/739,756

(22) Filed: Jan. 11, 2013

(65) Prior Publication Data

US 2014/0140728 A1 May 22, 2014

(30) Foreign Application Priority Data

Nov. 20, 2012 (TW) ..... 101143319 A

(51) Int. Cl.
*G03G 15/00* (2006.01)

(52) U.S. Cl.
USPC ..... 399/117

(58) Field of Classification Search
CPC ..... G03G 15/5008; G03G 15/757; G03G 21/1652; G03G 2221/1657; G03G 2221/166
USPC ..... 399/117, 167, 90
See application file for complete search history.

(56) References Cited

U.S. PATENT DOCUMENTS

| | | | | |
|---|---|---|---|---|
| 5,339,133 | A * | 8/1994 | Otomo et al. | 399/90 |
| 5,682,587 | A * | 10/1997 | Higeta et al. | 399/277 |
| 6,249,659 | B1 * | 6/2001 | Stickler | 399/90 |
| 6,885,838 | B2 * | 4/2005 | Kawai et al. | 399/167 |
| 7,680,437 | B2 * | 3/2010 | Schneider et al. | 399/119 |
| 2014/0072342 | A1 * | 3/2014 | Iijima et al. | 399/167 |

FOREIGN PATENT DOCUMENTS

| | | | |
|---|---|---|---|
| JP | 2001066848 A | * | 3/2001 |
| JP | 2004138777 A | * | 5/2004 |

* cited by examiner

*Primary Examiner* — Robert Beatty
(74) *Attorney, Agent, or Firm* — Muncy, Geissler, Olds & Lowe, P.C.

(57) ABSTRACT

A bearing mechanism for connection with a photosensitive drum and an electronic imaging device includes a transmission member for coupling a rotary driving member of the electronic imaging device, a conductive piece at an inner portion of the transmission member, a conductive bar, and a spring member. The transmission member is synchronously rotatably mounted to the photosensitive drum and includes a through hole. The conductive bar is slidably mounted into the through hoe of the transmission member for electrically contacting a conductive shaft of the electronic imaging device. The spring member is electrically connected between the conductive piece and the conductive bar for providing a rebound force forcing the conductive bar to move away from the inner portion of the transmission member. In this way, the axial offset between the transmission member and the rotary driving member can be compensated.

5 Claims, 6 Drawing Sheets

BEARING MECHANISM FOR PHOTOSENSITIVE DRUM

BACKGROUND OF THE INVENTION

1. Field of the Invention

The present invention relates generally to a photosensitive drum of an electronic imaging device and more particularly, to a bearing mechanism for a photosensitive drum.

2. Description of the Related Art

A conventional photosensitive drum is mounted inside an imaging device, like printer, and a bearing mechanism is mounted between the photosensitive drum and the imaging device for transmission of momentum and electricity. In the bearing mechanism of the conventional printer, as shown in FIG. 6, a conductive member 70 is mounted inside a through hole 61 of a transmission member 60 and electrically connected with a conductive piece 80 mounted to an inner portion of the transmission member 60 for abutting against a conductive shaft 90 of the electronic imaging device.

However, on some operational occasions, the transmission member 60 and the imaging device may not be interconnected tight enough, so unstable or imperfect electric contact between the conductive member 70 and the conductive shaft 90 may occur to bring a great adverse effect to the working performance of the photosensitive drum and the printer.

SUMMARY OF THE INVENTION

The primary objective of the present invention is to provide a bearing mechanism for a photosensitive drum, which can provide axial offset compensation and be applied to the photosensitive drum.

The foregoing objective of the present invention is attained by the bearing mechanism for connection with the photosensitive drum and an electronic imaging device having a rotary driving member and a conductive shaft mounted to an axle of the driving member. The bearing mechanism is composed of a transmission member, a conductive piece, a conductive bar, and a spring member. The transmission member is synchronously rotatably inserted into the photosensitive drum and has an inner portion located inside the photosensitive drum, an outer portion located outside the photosensitive drum, and a through hole communicating with the inner portion and the outer portion. The outer portion of the transmission member is adapted for being coupled with the rotary driving member to enable the transmission member to be driven by the rotary driving member for rotation. The conductive piece is mounted to the inner portion of the transmission member and provided with an external edge abutting against an internal wall of the photosensitive drum, such that the conductive piece is electrically connected with the photosensitive drum. The conductive bar is slidably mounted into the through hoe of the transmission member for electrically contacting the conductive shaft. The spring member is electrically stopped between the conductive piece and the conductive bar for providing a rebound force forcing the conductive bar to move away from the inner portion of the transmission member.

The conductive bar is slidably mounted into the through hole and the spring member resiliently abuts against the conductive bar to provide the axial offset compensation, so while the photosensitive drum having the bearing mechanism is installed to the electronic imaging device, even if axial offset occurs when the transmission member and the rotary driving member are not connected with each other tightly, the conductive bar can still keep electric connection with the conductive shaft subject to the resilience to secure the normal operation of the photosensitive drum and the printer.

DETAILED DESCRIPTION OF PREFERRED EMBODIMENTS

Figure 1:
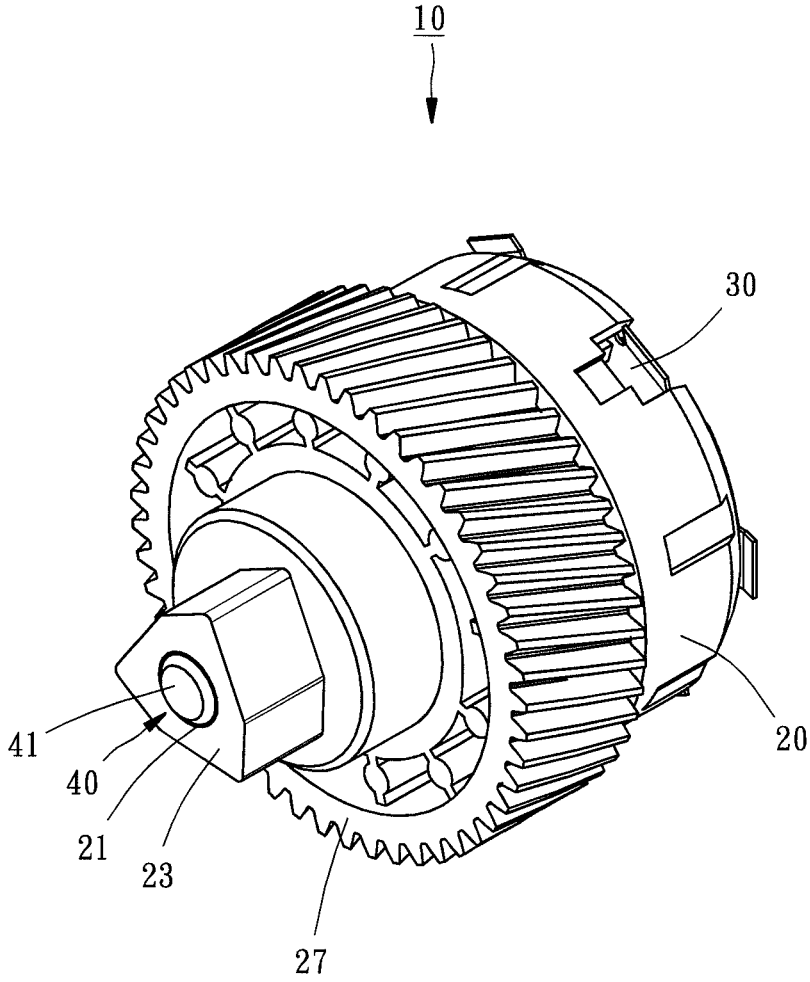
FIG. 1 is a perspective view of a preferred embodiment of the present invention.
Figure 2:
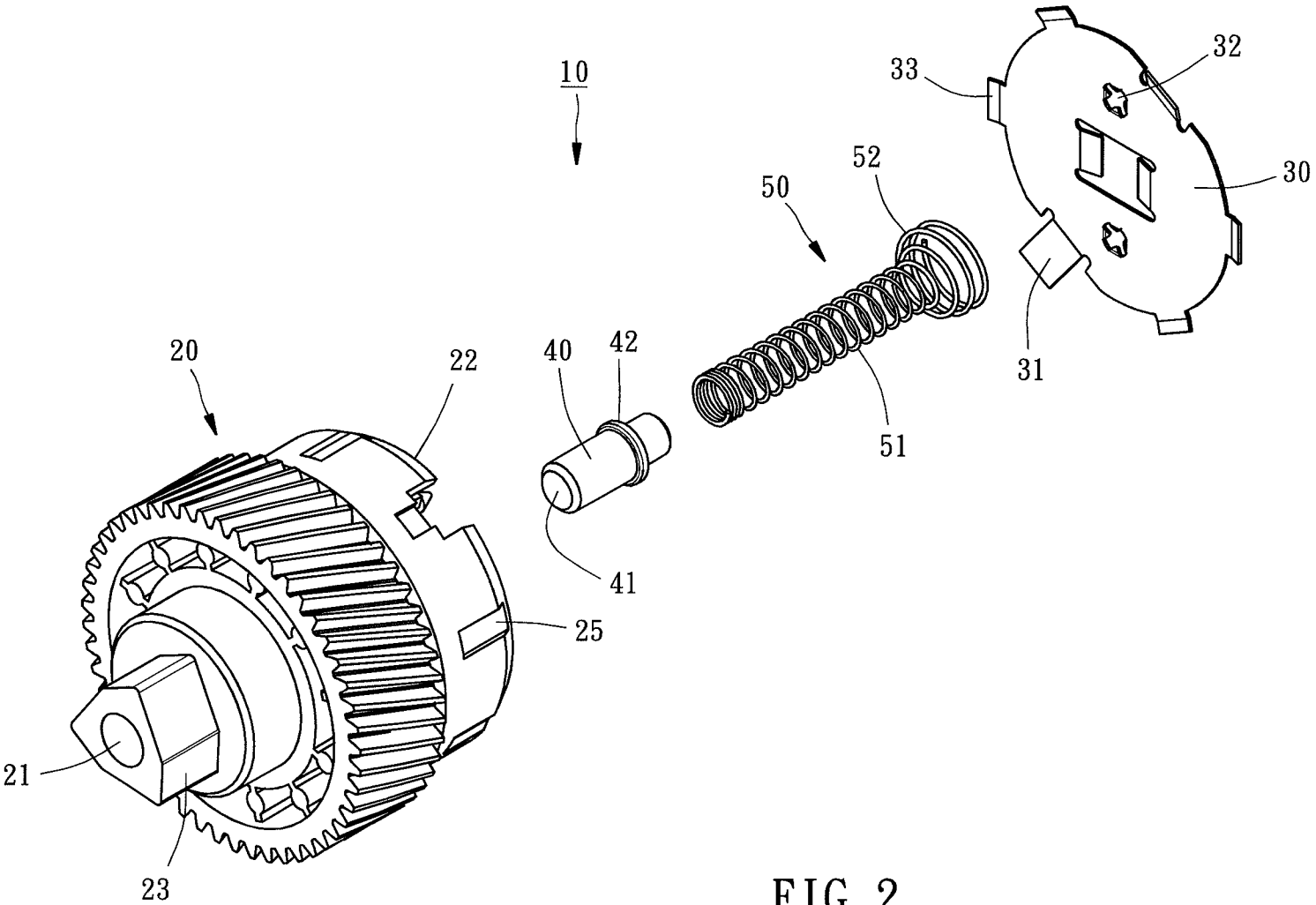
FIG. 2 is an exploded view of the preferred embodiment of the present invention.
Figure 3:
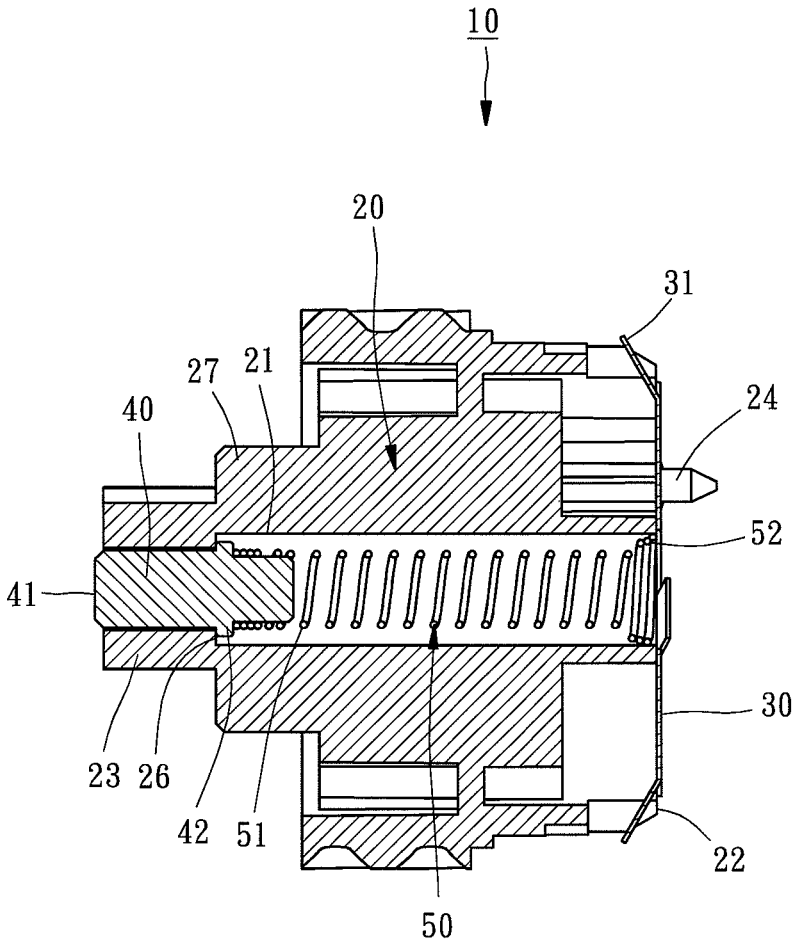
FIG. 3 is a sectional view of the preferred embodiment of the present invention.

Structural features and desired effects of the present invention will become more fully understood by reference to a preferred embodiment given hereunder. However, it is to be understood that these embodiments are given by way of illustration only, thus are not limitative of the claim scope of the present invention.

Referring to FIGS. 1-4, a bearing mechanism 10 for a photosensitive drum 1 in accordance with a preferred embodiment of the present invention can be connected with an electronic imaging device for operation. The electronic imaging device, like printer or photocopier, includes a rotary driving member 2 and a conductive shaft 3 mounted to an axle of the rotary driving member 2. The rotary driving member 2 has a non-circular, e.g. hexagonal, insertion slot 4 and a through hole 5 axially communicated with the insertion slot 4. The conductive shaft 3 is inserted into the through hole 5. The bearing mechanism 10 is formed of a transmission member 20, a conductive piece 30, a conductive bar 40, and a spring member 50. The detailed descriptions and operations of these elements as well as their interrelations are recited in the respective paragraphs as follows.

The transmission member 20 is synchronously rotatably inserted into the photosensitive drum 1 and includes a through hole 21, an inner portion 22 located inside the photosensitive drum 1, and an outer portion 27 formed outside the photosensitive drum 1. The through hole 21 communicates with the inner portion 22 and the outer portion 27. The outer portion 27 of the transmission member 20 can abut against the rotary driving member 2. For example, the transmission 20 can further include a protrusive portion 23 formed externally for insertion into the insertion slot 4 of the rotary driving member 2. The through hole 21 runs through the protrusive portion 23. The protrusive portion 23 is provided with a noncircular (e.g. hexagonal) shape corresponding to that of the insertion slot 4 in such a way that when the rotary driving member 2 is rotated, the transmission member 20 and the photosensitive drum 1 can be driven for rotation at the same time.

The conductive piece 30 is disk-shaped and mounted to the inner portion 22 of the transmission member 20 and includes a contact spring leaf 31 abutting against an internal wall of the photosensitive drum 1 for electric connection with the photosensitive drum 1. To position the transmission member 20 and the conductive piece 30, the transmission member 20 can have a plurality of positioning posts 24 and a plurality of retaining recesses 25 and the conductive piece 30 can have a plurality of retaining holes 32 for insertion of the positioning posts 24 and a plurality of claw-shaped pieces 33 engaged with the retaining recesses 25. However, how the transmission member 20 and the conductive piece 30 are positioned is not limited to the aforesaid manner.

The conductive bar 40 is slidably mounted to the through hole 21 of the transmission member 20 and includes a contact surface 41 for electric contact against the conductive shaft 3.

The spring member 50 can be a coil spring for electric connection between the conductive piece 30 and the conductive bar 40 and have one end sleeved onto the conductive bar 40, applying a rebound force to the conductive bar 40 to force the conductive bar 40 to move away from the inner portion 22 of the transmission member 20. To make the contact area between the spring member 50 and the conductive piece 30 be larger to secure the electric connection therebetween, the spring member 50 can have a small-diameter portion 51 electrically connected with the conductive bar 40 and a large-diameter portion 52 electrically connected with the conductive piece 30. In this embodiment, the spring member 50 is put for direct contact against the conductive bar 40 and the conductive piece 30 to be located therebetween. However, an alternative electrically conductive unit may be mounted between the spring member 50 and the conductive bar 40 or the conductive piece 40 to make the spring member 50 indirectly abut against the conductive bar or the conductive piece.

To prevent the conductive bar 40 from disengagement from the through hole 21, the transmission member 20 can further include a stepped portion 26 formed inside the through hole 21 and the conductive bar 40 can have a stop portion 42 for abutting against the stepped portion 26. The stop portion 42 is located between the stepped portion 26 and the spring member 50 in such a way that the conductive bar 40 fails to disengage from the through hole 21. Besides, the stop portion 42 can abut against the spring member 50 to force the spring member 50 to abut against the conductive bar 40 more securely. When the stop portion 42 abuts against the stepped portion 26, the contact surface 41 of the conductive bar 20 can be exposed outside the through hole 21 for convenient contact against and alignment with the conductive shaft 3.

Figure 4:
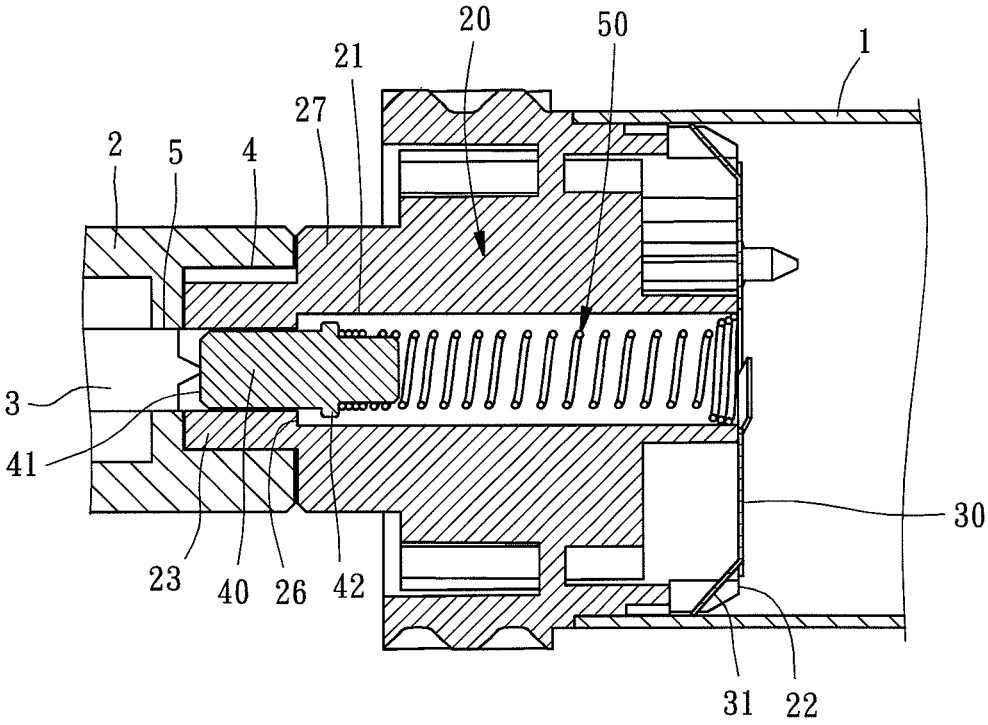
FIG. 4 is another sectional view of the preferred embodiment of the present invention, illustrating that the photosensitive drum having the bearing mechanism is mounted to the electronic imaging device and the bearing mechanism is fully inserted into the insertion slot.

Referring to FIG. 4, the protrusive portion 23 is fully inserted into the insertion slot 4 of the rotary driving member 2 and meanwhile, the conductive bar 40 electrically abuts against the conductive shaft 3 and slightly moves away toward the inner portion 22 of the transmission member 20.

Figure 5:
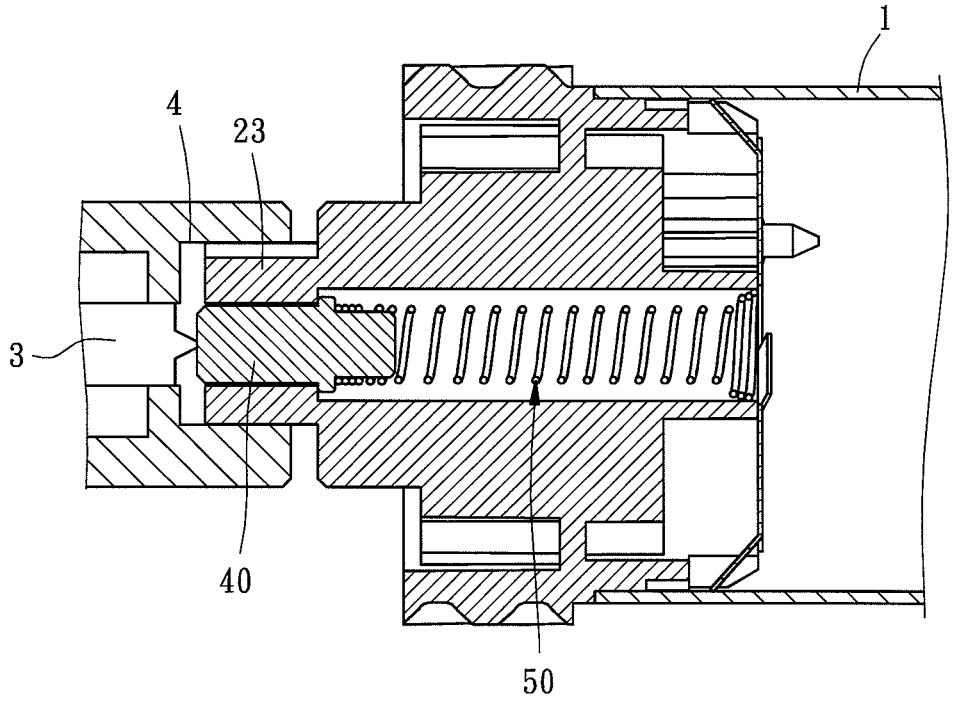
FIG. 5 is similar to FIG. 4, illustrating that the bearing mechanism is not fully inserted into the insertion slot.
Figure 6:
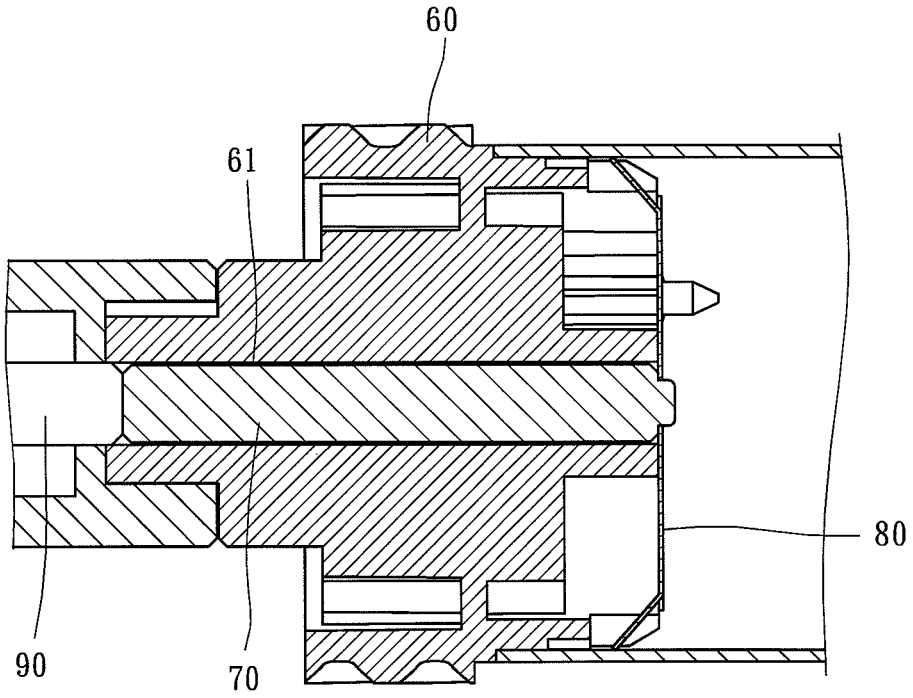
FIG. 6 PRIOR ART
FIG. 6 is a sectional view of a conventional photosensitive drum mounted inside the electronic imaging device.

Referring to FIG. 5, the protrusive portion 23 may fail to be fully inserted into the insertion slot 4 due to installing inaccuracy to result in axial offset. In this situation, the spring member 50 can apply a rebound force to the conductive bar 40 to push the conductive bar 40 outward to compensate the axial offset in such a way that the conductive bar 40 can still electrically abut against the conductive shaft 3 securely and the photosensitive drum 1 and the printer can work normally, thus avoiding the imperfect contact of the conventional structure.

What is claimed is:

1. A bearing mechanism for a photosensitive drum for connection with the photosensitive drum and an electronic imaging device, the electronic imaging device having a rotary driving member and a conductive shaft mounted to an axle of the rotary driving member, the bearing mechanism comprising:

a transmission member synchronously rotatably inserted into the photosensitive drum and having an inner portion located inside the photosensitive drum, an outer portion located outside the photosensitive drum, and a through hole communicating with the inner portion and the outer portion, the outer portion of the transmission member being for coupling with the rotary driving member to further enable the transmission member to be driven by the rotary driving member for rotation;

a conductive piece mounted to the inner portion of the transmission member and provided with an external side abutting against an internal wall of the photosensitive drum such that the conductive piece is electrically connected with the photosensitive drum;

a conductive bar slidably mounted inside the through hole of the transmission member for electrically abutting against the conductive shaft; and a spring member electrically connected between the conductive piece and the conductive bar for applying a rebound force to the conductive bar to drive the conductive bar toward a direction away from the inner portion of the transmission member, wherein the transmission member comprises a stepped portion formed inside the through hole and the conductive bar comprises a stop portion for abutting against the stepped portion, the stop portion being located between the stepped portion and the spring member.

2. The bearing mechanism for a photosensitive drum as defined in claim 1, wherein the conductive bar comprises a contact surface for electrically abutting against the conductive shaft; when the stop portion abuts against the stepped portion, the contact surface is exposed outside the through hole.

3. The bearing mechanism as for a photosensitive drum defined, in claim 1, wherein the spring member is a coil spring having an end sleeved onto the conductive bar and abutting against the stop portion.

4. The bearing mechanism as for a photosensitive drum defined in claim 1, wherein the spring member is a coil spring having a small-diameter portion and a large-diameter portion, the small-diameter portion abutting against the conductive bar, the large-diameter portion electrically abutting against the conductive piece.

5. The bearing mechanism as for a photosensitive drum defined in claim 1, wherein the transmission member comprises a protrusive portion formed at the outer portion thereof for insertion into an insertion slot of the rotary driving member; the through hole runs through the protrusive portion; the conductive bar electrically abuts against the conductive shaft located inside the insertion slot.

* * * * *